US006212845B1

(12) United States Patent
De Zen

(10) Patent No.: US 6,212,845 B1
(45) Date of Patent: Apr. 10, 2001

(54) INSULATED WALL AND COMPONENTS THEREFOR

(75) Inventor: Vittorio De Zen, Woodbridge (CA)

(73) Assignee: Royal Building Systems (CDW) Limited, Ontario ( * ) Notice: Subject to any disclaimer, the term of this patent is extended or adjusted under 35 U.S.C. 154(b) by 0 days.

(21) Appl. No.: 09/125,973

(22) PCT Filed: Feb. 28, 1997

(86) PCT No.: PCT/CA97/00135

§ 371 Date: Aug. 28, 1998

§ 102(e) Date: Aug. 28, 1998

(87) PCT Pub. No.: WO97/32095

PCT Pub. Date: Sep. 4, 1997

(30) Foreign Application Priority Data

Feb. 29, 1996 (CA) ..... 2170681

(51) Int. Cl.[7] ..... E04B 5/04

(52) U.S. Cl. ..... 52/607; 52/606; 52/144; 52/145; 52/309.12; 52/309.15

(58) Field of Search ..... 52/606, 607, 404.3, 52/404.4, 405.1, 309.15, 309.17

(56) References Cited

U.S. PATENT DOCUMENTS 4,819,396 * 4/1989 Cruise ..... 52/405
5,193,318 * 3/1993 D'Antonio et al. ..... 52/144
5,615,529 * 4/1997 Johnson et al. ..... 52/604

FOREIGN PATENT DOCUMENTS 957816 11/1974 (CA) .
2107725 5/1973 (FR) .
2721054 6/1994 (FR) .
WO 94/28262 * 5/1993 (WO) .
WO 95/00724 * 1/1995 (WO) ..... 2/86

* cited by examiner

*Primary Examiner*—Carl D. Friedman
*Assistant Examiner*—Patrick J. Chavez

(57) ABSTRACT

A novel insulated wall structure is formed with upright hollow thermoplastic extrusions connected together in a row, with the extrusions presenting a row of compartments (15,22,30) adapted to receive concrete (39) extending along the length of the wall structure and a row of compartments (16,23,33) containing or adapted to receive insulation (38) material also extending along the length of the wall along side or in parallel with the row of concrete receiving compartments (15,22,30) whereby when the compartments (15,22,30) adapted to receive concrete (39) are filled with concrete (39) and the insulation (38) receiving compartments (16,23,33) are filled with insulation (38) the insulation (38) in said insulation (38) receiving compartments (16,23, 33) is positioned to block heat transfer through the wall. Also novel wall forming units or components for the wall structure in the form of elongated hollow thermoplastic extrusions having internal walls (12,13,14,21,29,32) to provide the requisite concrete (39) receiving and insulation (38) receiving or containing compartments (15,16,22,23,30,33).

13 Claims, 16 Drawing Sheets

62
70
72
69
65
68
65
63
63
64
62
59
64
60
67
61
63
65
63
66
65
68
74
71
73
72
69
70
73
74
74
71
71

INSULATED WALL AND COMPONENTS THEREFOR

FIELD OF INVENTION

This invention relates to novel wall structures for housing and other buildings and novel components therefor.

More particularly the invention relates to the creation of a wall structure of confined poured concrete which is fully insulated at the time of its erection and novel components for use in forming same.

BACKGROUND OF THE INVENTION

Conventionally poured concrete walls used, for example, as basement and other exterior walls for housing and other building structures involve the erection of suitable form work defining the wall shape, pouring concrete into the form work, and, when same is sufficiently set, removing the form work.

It has been proposed in European Patent Application EP O 1320 745 to erect a wall of hollow interlocking thermoplastic components which then can be filled with cementitious material if desired.

In my early PCT application PCT/CA94/00274, I disclosed an arrangement of extruded thermoplastic components which can be interlocked together to form a wall structure for receiving concrete therein with internal communication provided between the interlocking components so that concrete poured therein can flow therebetween to provide a thermoplastic wall structure held in interlocked relation and converted to a permanent wall by the concrete confined therein.

In all such previous wall structures, the need to insulate the walls against heat transfer requires the carrying out of entirely separate operations and procedures usually by different trades which add significantly to the building costs.

SUMMARY OF THE INVENTION

The present invention is directed to eliminating the aforesaid need to separately insulate building walls by creating the walls as fully insulated walls at the time of their erection.

According to the present invention, the novel insulated wall structure is formed with upright hollow thermoplastic extrusions connected together in a row, with the extrusions presenting a row of compartments adapted to receive concrete extending along the length of the wall structure and a row of compartments containing or adapted to receive insulation material also extending along the length of the wall along side or in parallel with said row of concrete receiving compartments whereby when said compartments adapted to receive concrete are filled with concrete and said insulation receiving compartments are filled with insulation, the insulation in said insulation receiving compartments is positioned to block heat transfer through the wall.

According to the preferred embodiment of the invention, the hollow thermoplastic extrusions are provided with interlocking means to interlock with adjoining extrusions and the row of concrete receiving compartments are in internal communication so that concrete can flow between compartments.

As will be understood, any suitable insulating material such as fiberglass or the like may be introduced into the insulation receiving compartments or the insulation receiving compartments may be filled with foamed insulation such as polyurethane foam or the like as desired.

The present invention also resides in providing novel wall forming units or components in the form of elongated hollow thermoplastic extrusions adapted to be assembled into a wall structure and having internal walls to provide the requisite concrete receiving and insulation receiving or containing compartments.

In this aspect of the invention, the novel wall forming units or components are in the form of an elongated hollow thermoplastic extrusion presenting two spaced walls which, when the unit or component is incorporated in an upright position into a wall structure, form upright exterior wall segments of the wall structure, the spaced walls being held in spaced relation by at least two transverse walls extending therebetween with at least one internal wall extending between the at least two transverse walls intermediate of the spaced walls to divide the interior of said unit or component into at least two compartments, one to receive concrete or the like, the other to receive insulating material to block heat transfer between said spaced walls.

In the preferred embodiment of the invention, the units or components are provided with interlocking means to interlock with adjoining components and the transverse walls of the component have openings therein providing communication with the interior of the concrete receiving compartment.

BRIEF DESCRIPTION OF THE DRAWINGS

FIG. 15 is a broken away perspective view illustrating the assembly of interlocking components corresponding to the components of FIGS. 3 and 4 in which the components comprise extrusions having a protective skin covering surfaces thereof which become exposed when the components are interlocked together for use in above ground insulated walls exposed to strong ultraviolet radiations and the like.

DETAILED DESCRIPTION ACCORDING TO THE PREFERRED EMBODIMENTS OF THE PRESENT INVENTION

Figure 1:
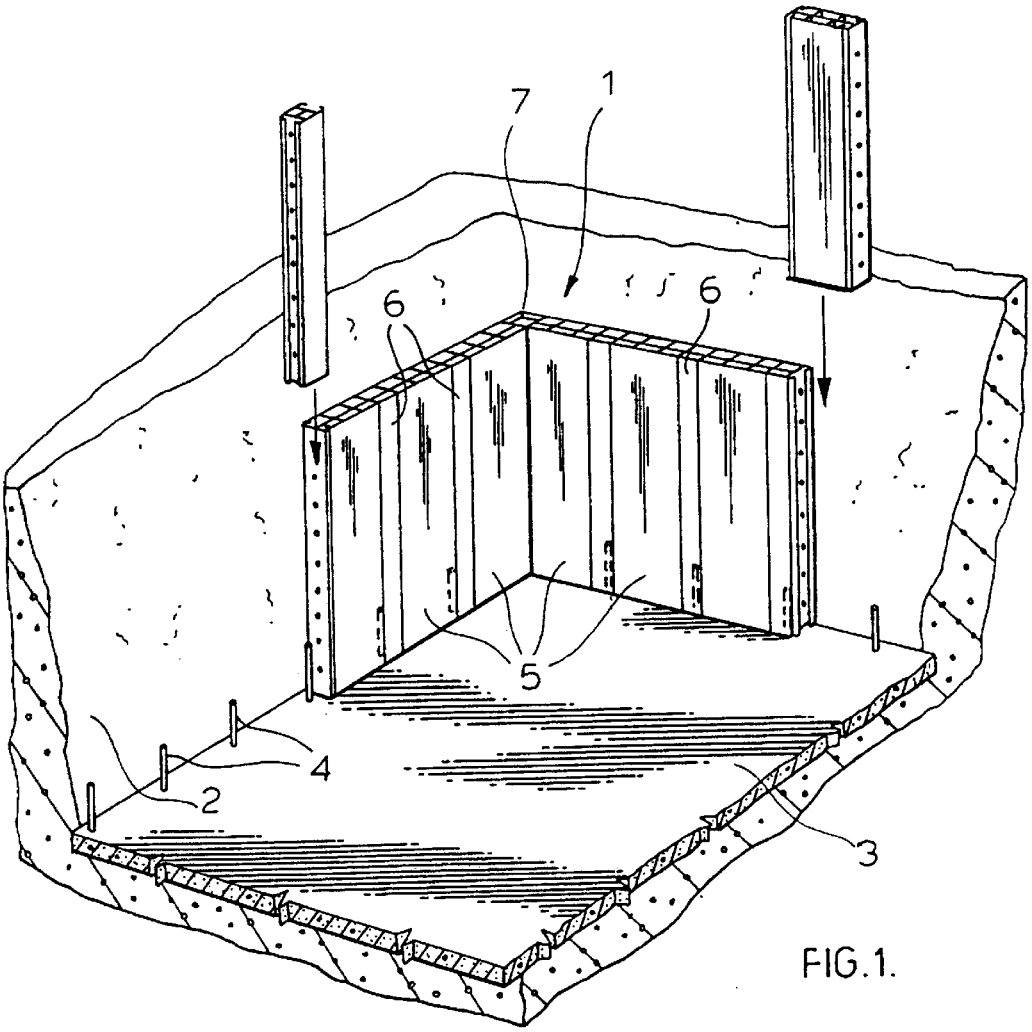
FIG. 1 is a broken away perspective view illustrating the erection of an insulated basement wall in accordance with the invention utilizing novel wall forming components of the invention.

FIG. 1 illustrates the erection of an insulated basement wall embodying the invention employing novel wall forming components of the invention.

As illustrated in FIG. 1 in erecting the basement wall generally designated at 1 an excavation 2 is made and preferably a poured concrete basement floor 3 is provided with upright reinforcing rods 4 arranged around the perimeter in appropriately spaced relation.

The wall illustrated in FIG. 1 is made up of wall forming panels 5, wall forming members in the form of box connectors 6 and corner members 7 only one of which is shown.

Figure 3:
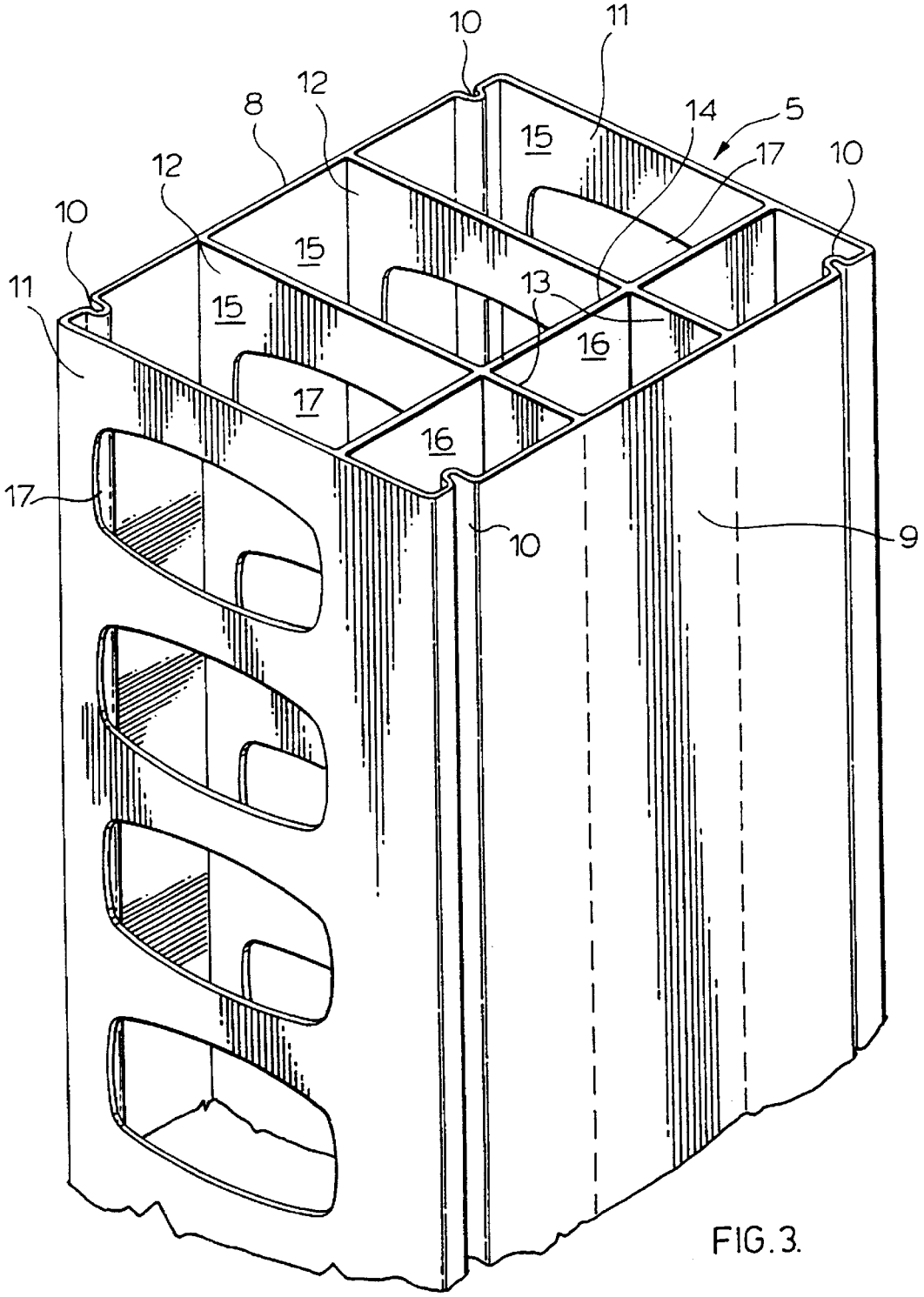
FIG. 3 is a broken away perspective view of one of the wall forming panel extrusions according to the invention.

As illustrated in FIG. 3, each of the wall forming panels 5 comprises an elongated hollow extrusion of thermoplastic material of generally rectilinear form presenting opposing faces 8 and 9 which when the panel is integrated into the wall 1 form exterior faces of the wall. The faces 8 and 9 of the panel are formed with longitudinal grooves 10 adjacent to the edge or end walls 11 which complete the rectilinear form of the extrusion.

The walls 11 have a width slightly less than the spacing between the opposed walls 8 and 9 so that they form with the grooves 10 a tongue and groove interlock formation for interlocking engagement with an adjoining component in the form of a box connector 6 as hereinafter more fully explained.

The interior of the wall forming panel 5 is divided by partitions 12, 13 and 14 to divide the interior of the panel into compartments 15 adapted to receive concrete and compartments 16 adapted to receive an insulating material.

The edge or end walls 11 and the partitions 12 have material cut out therefrom to provide openings 17 of generally ovoid form to provide internal communication between the compartments 15 and between interlocked wall components as hereinafter more fully explained.

The wall forming panels 5 are preferably formed as extrusions of polyvinyl chloride using suitable fillers or reinforcing agents such as calcium carbonate as required. These extrusions are cut to a length corresponding to the desired height of the wall and in use are arranged in an upright position with the compartments 15 and 16 opening to the top and bottom of the wall.

Figure 4:
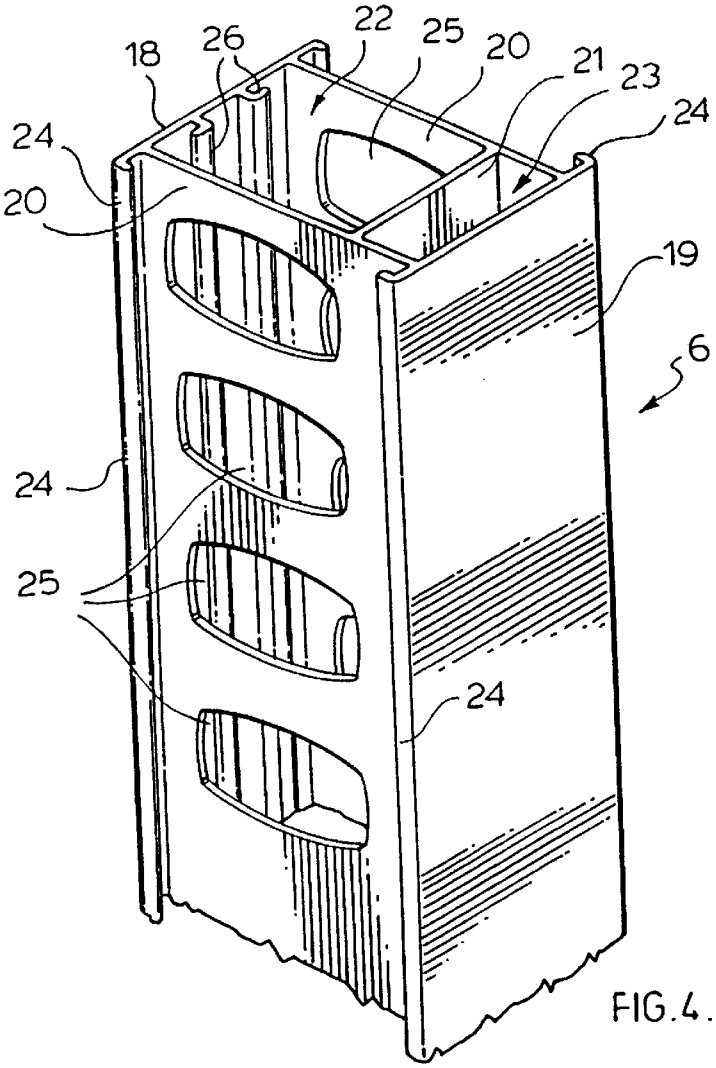
FIG. 4 is a broken away perspective view of one of the extruded box connector wall forming components embodying the invention.

FIG. 4 is an enlarged view of the one of the box connectors 6 adapted to interlockingly engage with the wall forming panels 5.

The box connector like the wall panels 5 and as well the corner members 7 are formed as longitudinal extrusions of thermoplastic material preferably PVC with suitable fillers or reinforcing agents such as calcium carbonate to give appropriate stability and strength as will be understood by those skilled in the art.

Figure 2:
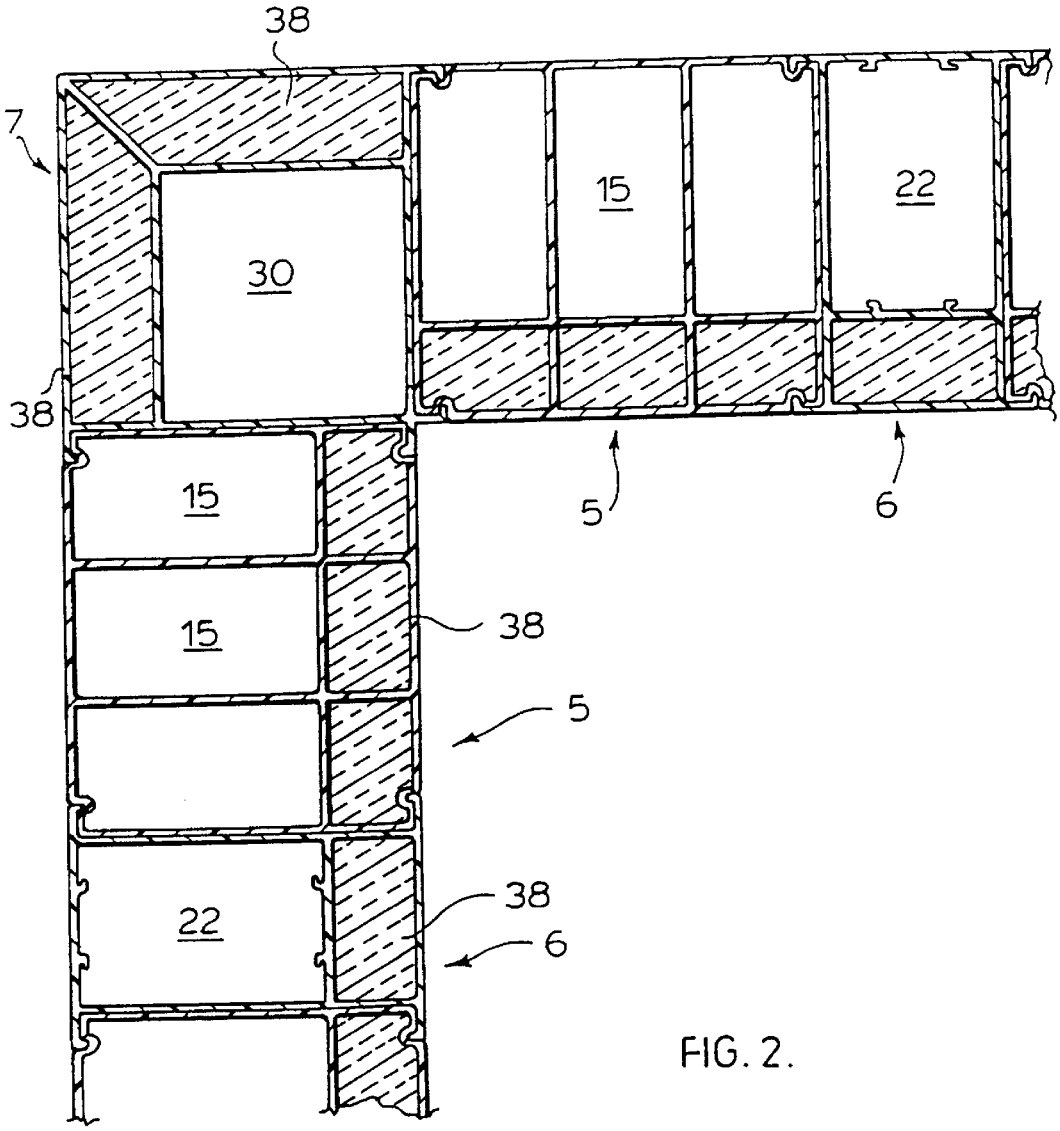
FIG. 2 is a top plan view on an enlarged scale of a corner section of the wall of FIG. 1.

Box connector 6 again has a generally rectilinear profile presenting opposed faces 18 and 19 which are adapted to form exterior wall segments when the box connector is connected into a wall structure as illustrated in FIGS. 1 and 2.

The opposed walls 17 and 18 are connected by transverse walls, or webs 20 to define the hollow configuration of the box connector while a wall or web 21 extending between the walls 20 divide the interior of the box connector into two compartments, a larger compartment 22 adapted to receive concrete and a smaller compartment 23 adapted to receive insulation material.

The walls 18 and 19 extend outwardly beyond the transverse walls 20 and have at their extremities inturned fingers 24 which provide locking fingers to engage in the longitudinal grooves 10 of the wall forming panels 5.

The transverse walls or webs 20 have material cut out therefrom to provide openings 25 corresponding to the openings 17 in the wall forming panels 5 so that when the box connectors are interlockingly engaged with the panels communication is provided therethrough with the interior of the panels to allow for the concrete introduced into the wall structure, preferably into the box connectors to flow internally through the wall.

The box connectors 6 preferably are formed with spaced undercut rails 26 for slideable engagement with a suitable channel member, not shown, whereby an isolated compartment can be provided to receive wiring and the like which can be kept out of contact with concrete in the compartment 22.

Figure 5:
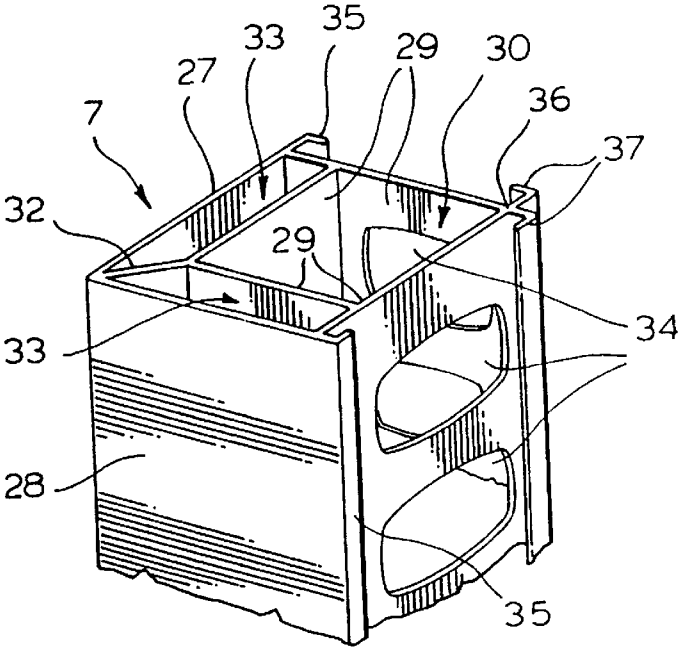
FIG. 5 is a broken away perspective view of one of the extruded wall forming corner components according to the invention.

FIG. 5 is an enlarged view of the corner member 7 which comprises an elongated extrusion of the same thermoplastic material as the wall forming panels 5 and box connectors 6.

Again the corner extrusion 7 is of hollow rectilinear form and has two solid walls 27 and 28 which are at right angular relation to each other and which, when the corner member is incorporated into a wall structure as illustrated at 1, form exterior walls of the structure.

Right angular walls or webs 29 complete the hollow form of the corner extrusion 7, the interior of which is divided into a main compartment 30 by the rectangularly arranged walls or webs 29. An angled wall or web 32 connecting the corner juncture of the outside walls 27 and 28 and the corner juncture of the walls 29 defines a pair of compartments 33.

The compartments 33 are adapted to receive an insulating material while the main compartment 30 is adapted to receive concrete which can flow into the compartment from adjoining interconnected panel members through the openings 34 in the walls 29.

The corner members 7 are provided with interlocking means similar to the box connectors 4 for engaging in the grooves of the panel members 5. In this connection, the walls 27 and 28 of the corner member opposite their corner juncture extend outwardly beyond the walls 29 and terminate in inturned locking fingers 35 while the walls 29 extend outwardly beyond their juncture 36 and present corresponding inturned locking fingers 37.

The opposing inturned locking fingers 35 and 37 are adapted to slidingly interlock in the longitudinal grooves on opposite sides of the wall panels 5 as illustrated in FIG. 2.

It will be understood that the compartmentalized extrusions 5, 6 and 7 will be transported to the job site and erected into the desired wall structure, or a portion thereof, before concrete is introduced into the concrete receiving compartments. Normally however the insulation receiving compartments will be filled with insulation material following the extrusion process and prior to delivery to the job site.

Figure 6:
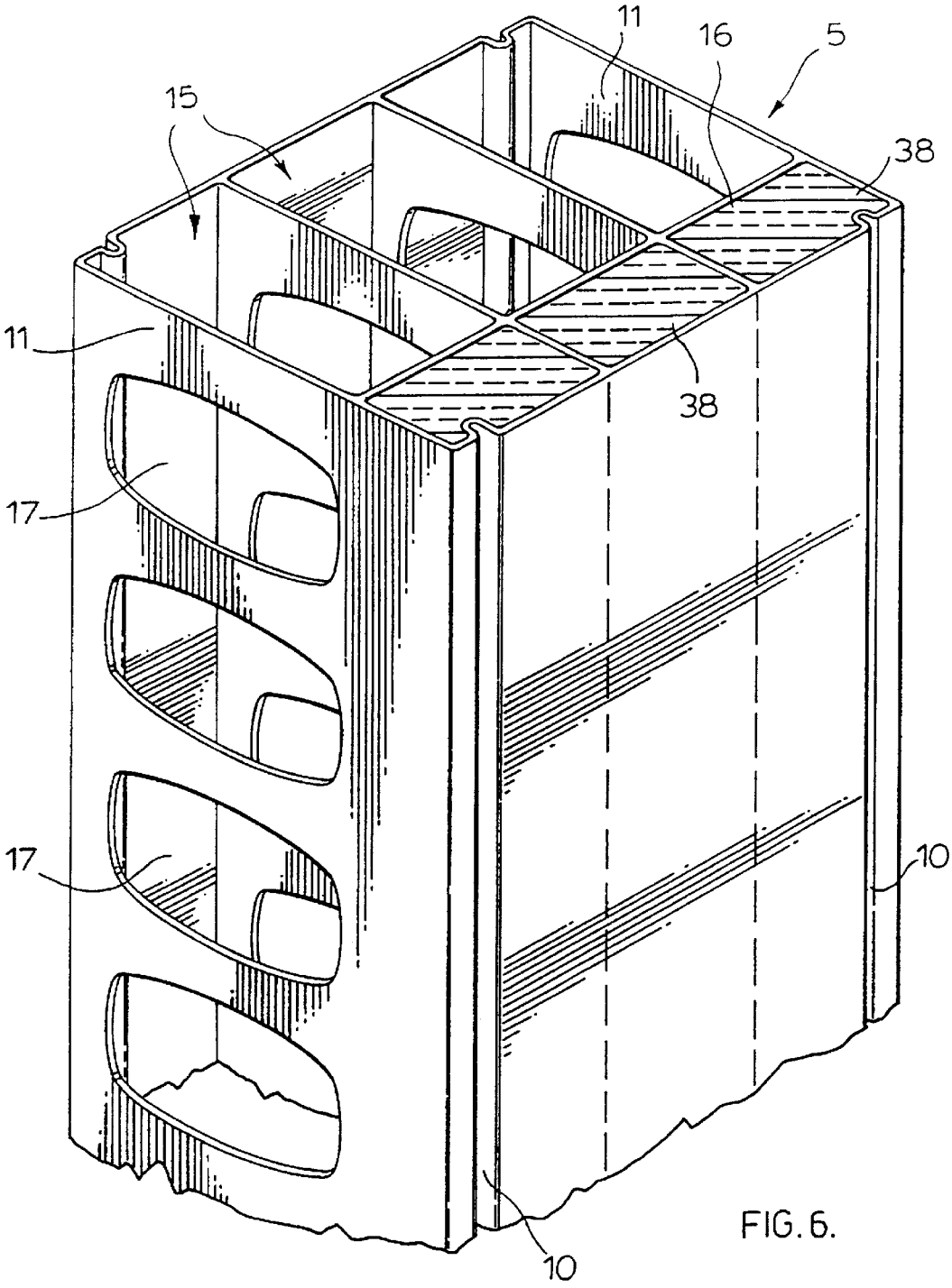
FIG. 6 is a broken away perspective view of the panel component of FIG. 3 with the insulation receiving compartments filled with insulation.

Thus for example as illustrated in FIG. 6 the wall forming panel 5 has the compartments 16 filled with insulating material 38 of any suitable material such as fiber glass, rock wool and the like or polyurethene or similar material may be foamed into these compartments.

Thus normally the wall forming components as comprised for example by the wall forming panels 5, box connectors 6, and corner members 7 will be shipped to the job site as insulation containing components ready to be assembled in interlocking engagement as illustrated in FIG. 2 into the desired wall formation. It will be noted that the arrangement of the insulation receiving compartments 16, 23 and 33 of these wall forming members 5, 6 and 7 are all disposed in a position to block heat transfer through from the outside of the wall structure 1 to the interior of the wall structure.

When the wall or an appropriate portion of the wall has been assembled together, concrete is introduced, preferably into the box connectors 6 which have been sleeved down unto the reinforcing rods 4 in the basement wall illustrated in FIG. 1, and this concrete can flow laterally internally of the wall through the various openings 17, 25 and 34 to fill the interior of the wall and convert same into a concrete encased fully insulated wall structure.

For purposes of illustration, one of the panels 5 is shown isolated out of the finished wall structure with the adjoining box connectors removed to show how the concrete 39 fills the concrete receiving compartments 15 while the insulation receiving compartments are shown as filled with insulation 38 of cellular form.

It will be understood that reinforcing rods 40 running longitudinally of the wall may be employed as desired for added structural strength of the wall.

Figure 7:
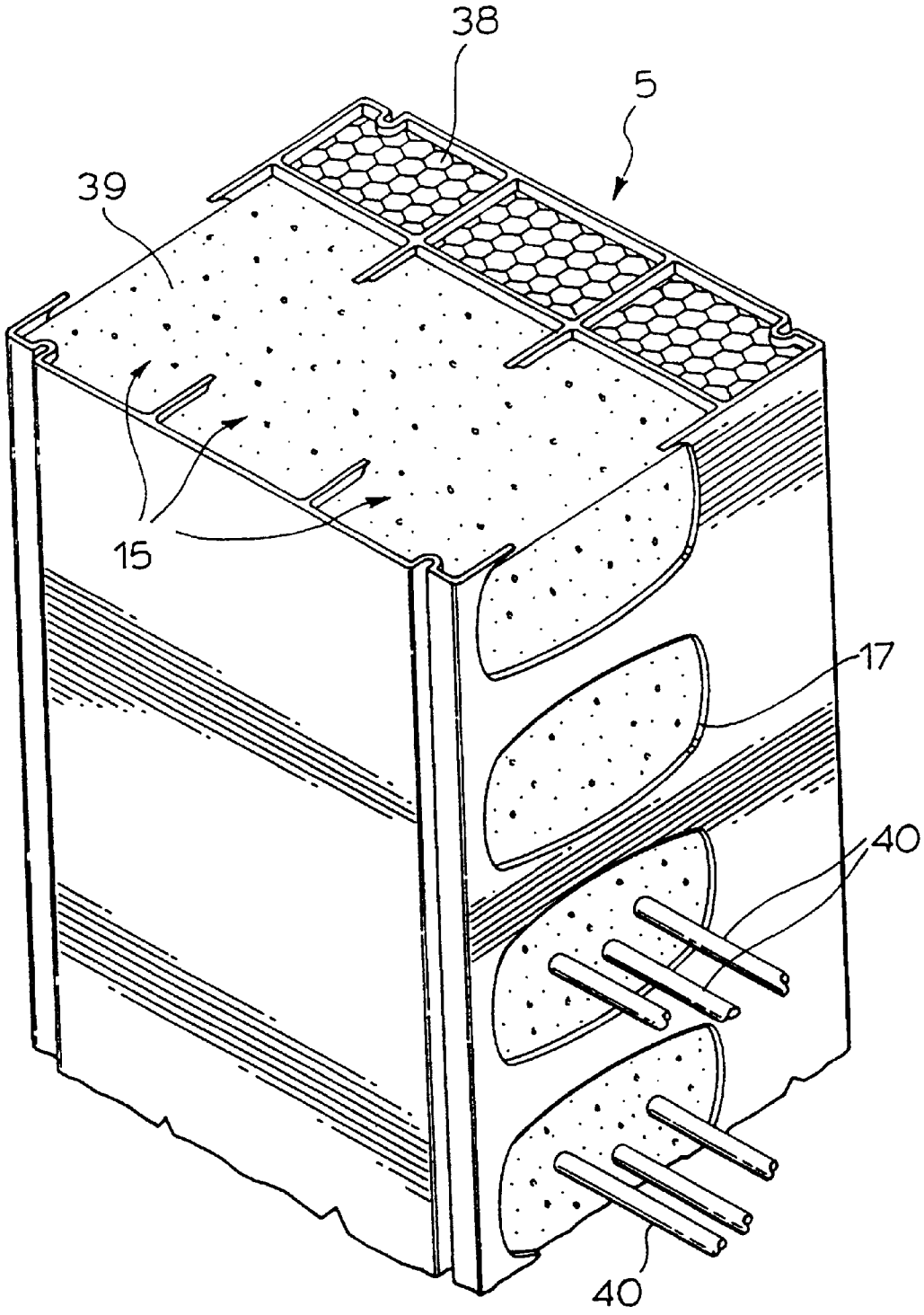
FIG. 7 is a broken away perspective view illustrating the panel component of FIG. 3 as it would appear in the finished wall with the insulation receiving compartments filled with insulation and the concrete receiving compartments filled with concrete, the adjoining components being omitted for sake of clarity.
Figure 8:
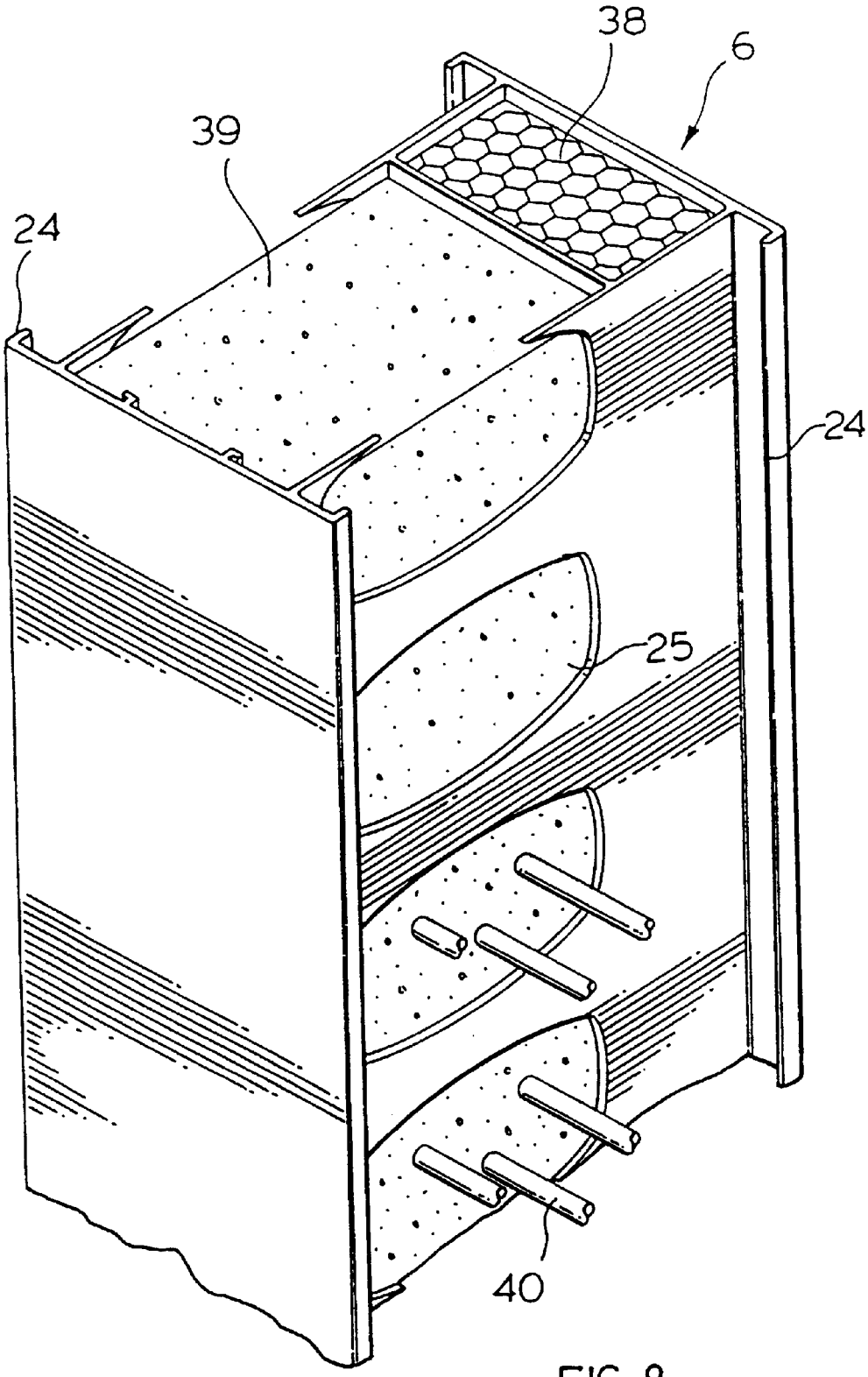
FIG. 8 is a broken away perspective view of the box connector FIG. 4 as it would appear in the finished wall with the insulation receiving compartment filled with insulation and the concrete receiving compartment filled with concrete, the adjoining wall components being omitted for sake of clarity.

FIG. 8 is a view similar to FIG. 7 of a box connector 6 isolated from the wall showing its compartment 22 filled with concrete and its compartment 23 filled with insulating material.

Figure 9:
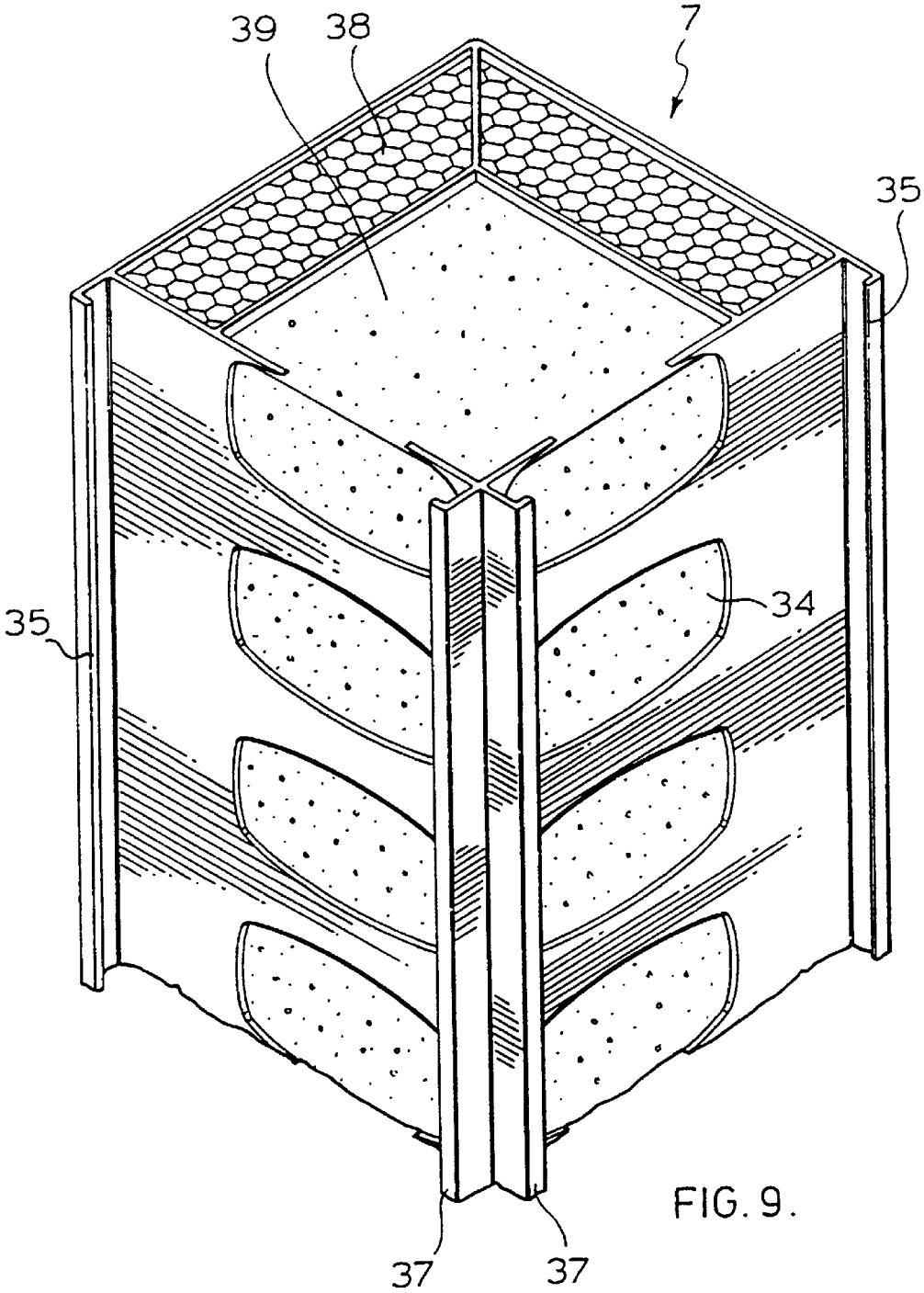
FIG. 9 is a perspective view of the corner component of FIG. 5 as it would appear in the finished wall with the insulation receiving compartments filled with insulation and the concrete receiving compartment being filled with concrete, the adjoining connected wall components being omitted for sake of clarity.

Similarly FIG. 9 illustrates a corner member 7 isolated from the wall and after its compartment 30 has been filled with concrete.

Figure 10:
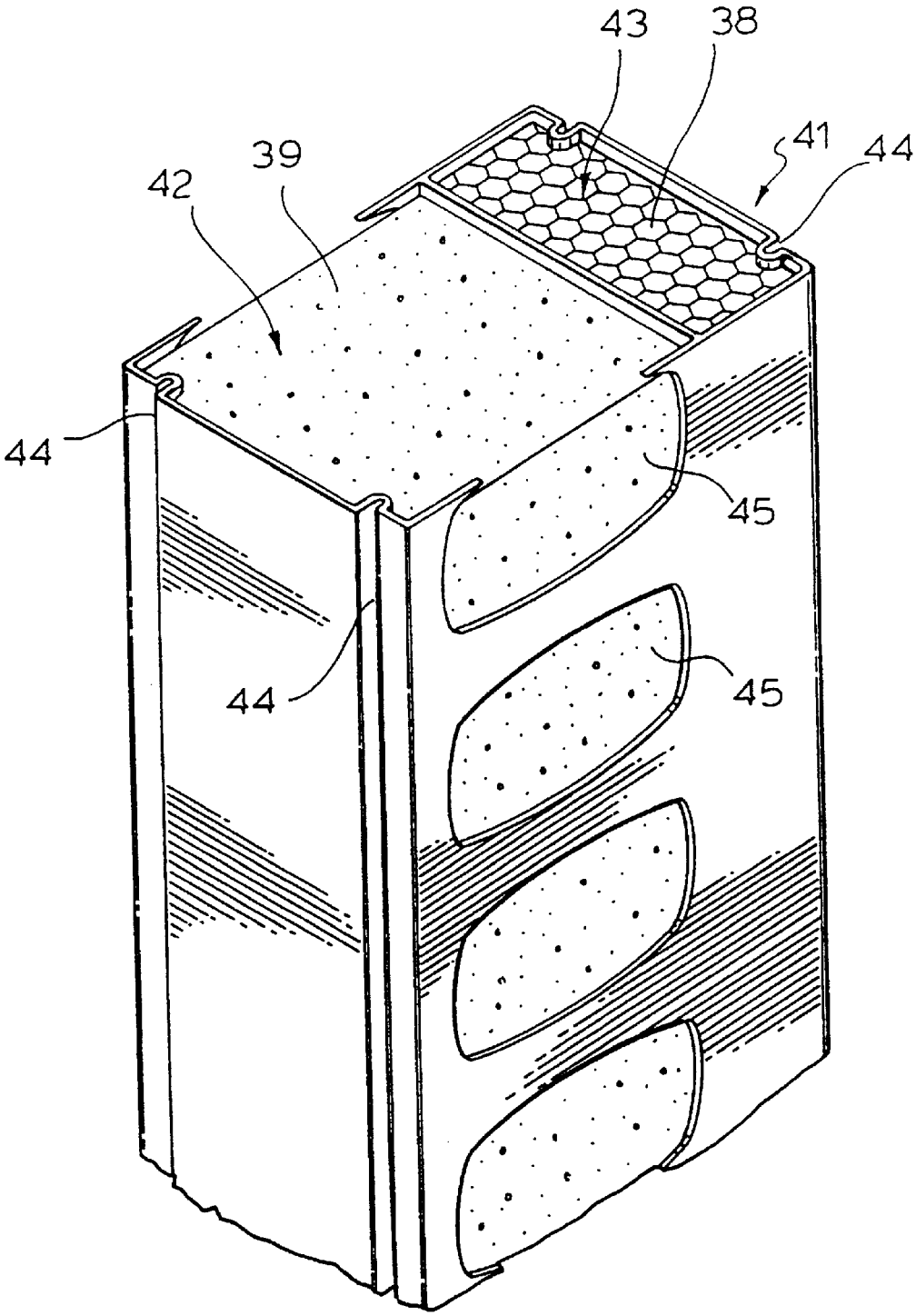
FIG. 10 is a broken away perspective view of an extruded panel component as it would appear in a finished wall according to the invention having a single insulation receiving compartment filled with insulation and a single concrete receiving compartment filled concrete, the adjoining components being omitted for sake of clarity.

FIG. 10 is a perspective view of a wall forming panel member 41 having a single concrete receiving compartment 42 and a single insulation receiving compartment 43, but otherwise the same as panel 5 being provided with locking grooves 44 and openings 45 opening into the interior of the concrete receiving chamber 42. As illustrated, the chamber 42 is shown as filled with concrete 39 and the insulation receiving compartment 43 filled with insulation 38 as it would appear with the panel 41 incorporated into a finished wall structure.

While it will be appreciated that the invention is not limited to specific dimensions of the wall forming components such as the panels 5, box connectors 6 and corner members 7 and the walls formed thereby when same are interlockingly engaged, testing has shown that an efficiently insulated permanent wall of great strength is provided with the width of the components between their walls which become exterior walls when they are assembled into the wall formation is of the order of 8 inches. Thus the spacing between walls 8 and 9 of the panels 5 and the walls 18, 19 of the box connectors 6 would be of the order of 8 inches. The thickness of these walls 8, 9, 18 and 19 would be of the order of 1/10th of an inch.

Of the 8 inches of width of the components, the insulation compartments, eg. compartments 16 of the wall forming panels, compartments 23 of the box connectors, would occupy of the order of 2 inches while the concrete receiving compartments of these members 15 and 22 respectively have a width occupying the rest of the space being of the order of 6 inches.

It will be understood that the narrow wall forming panel members 41, and the corner member 7, will have similar dimensions to provide for an insulation barrier having a thickness of the order of 2 inches and providing, when the concrete compartments are filled with concrete, a concrete core of the order of 6 inches.

The walls or webs of the components such as the webs 20 and 21 of the wall forming panels 5 which divide the components into internal compartments may have a thickness somewhat less than the walls, such as 8 and 9, which become external walls of the wall structure.

It will be understood that the components of the invention can be interlockingly connected into a wall formation with the insulation containing compartments either at the outside of the wall or the inside of the wall as desired.

Figure 11:
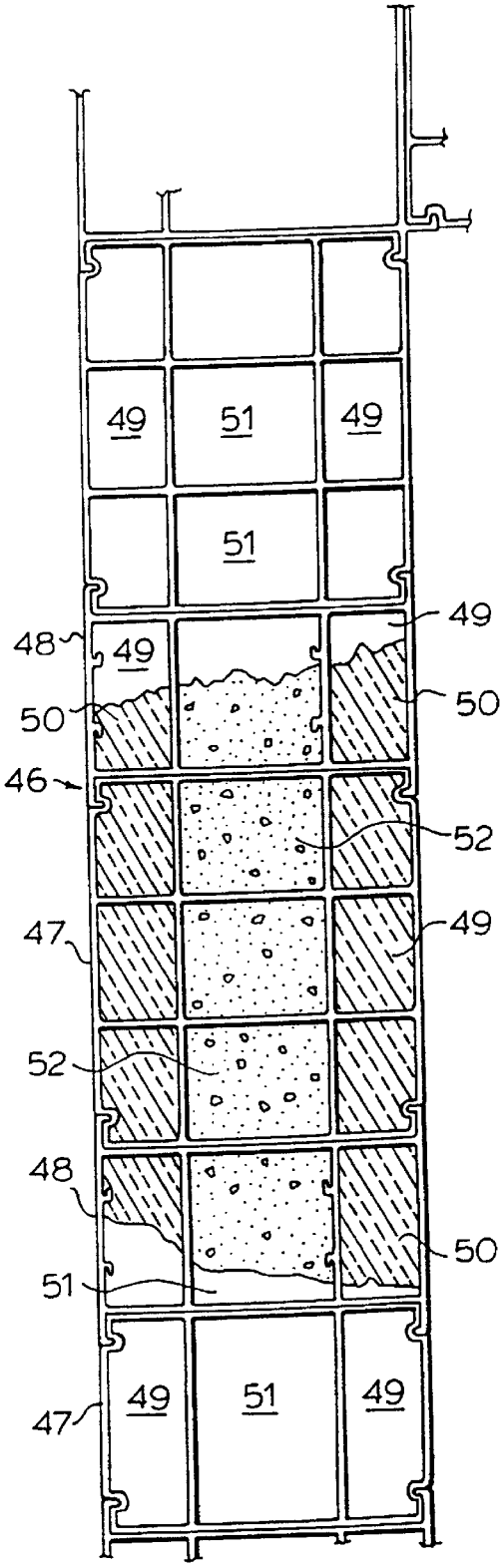
FIG. 11 is a plan view looking down on a section of a wall embodying the invention in which the wall forming components present central concrete receiving compartments bordered on each side by insulation. receiving compartments.
Figure 12:
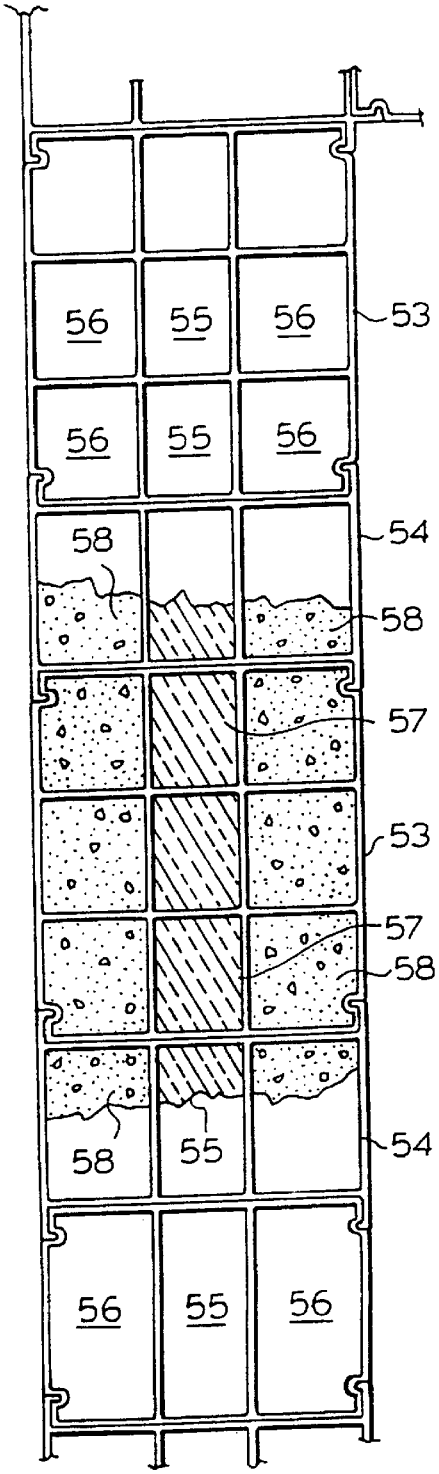
FIG. 12 is a plan view of a segment of a wall structure according to the invention in which the wall forming components present a central insulation receiving compartment bordered on each side by concrete receiving compartments.

While the invention in its basic form provides wall forming components which, when interlocked together as illustrated in FIG. 2, provide a single row of insulation containing compartments arranged to block heat transfer through the wall between the exterior and inner surfaces and single row of intercommunicating concrete receiving compartments to be filled with concrete, other walls embodying the invention, such as illustrated in FIGS. 11 and 12, can also be provided. In each case there is provided a concrete encased insulated wall without the need for additional insulation.

In FIG. 11, the wall structure designated at 46 is comprised of panels 47 and box connectors 48 interlocked together in the same manner as the panels 5, and box connectors 6, shown in FIG. 2, but differ from these panels 5 and 6 by the provision of two spaced rows of insulation receiving compartments 49 which, in the completed wall, are filled with insulation material 50, and a central row of concrete receiving compartments 51 which, in the completed wall, are filled with concrete 52 interposed between the insulation compartments 49. As in the case of the components 5 and 6, the concrete receiving compartments will be in communication with each other through suitable openings (not shown) corresponding to the openings 17.

FIG. 12 is the reverse of FIG. 11 in which the panels 53 and box connectors 54 present a central row of insulation receiving compartments 55 bordered on each side by rows of concrete receiving compartments 56. In the completed wall, the compartments 55 will be filled with insulation material 57 and the concrete compartments filled with concrete 58 with the compartments 56 providing for flow of concrete internally and through to adjoining compartments.

Figure 13:
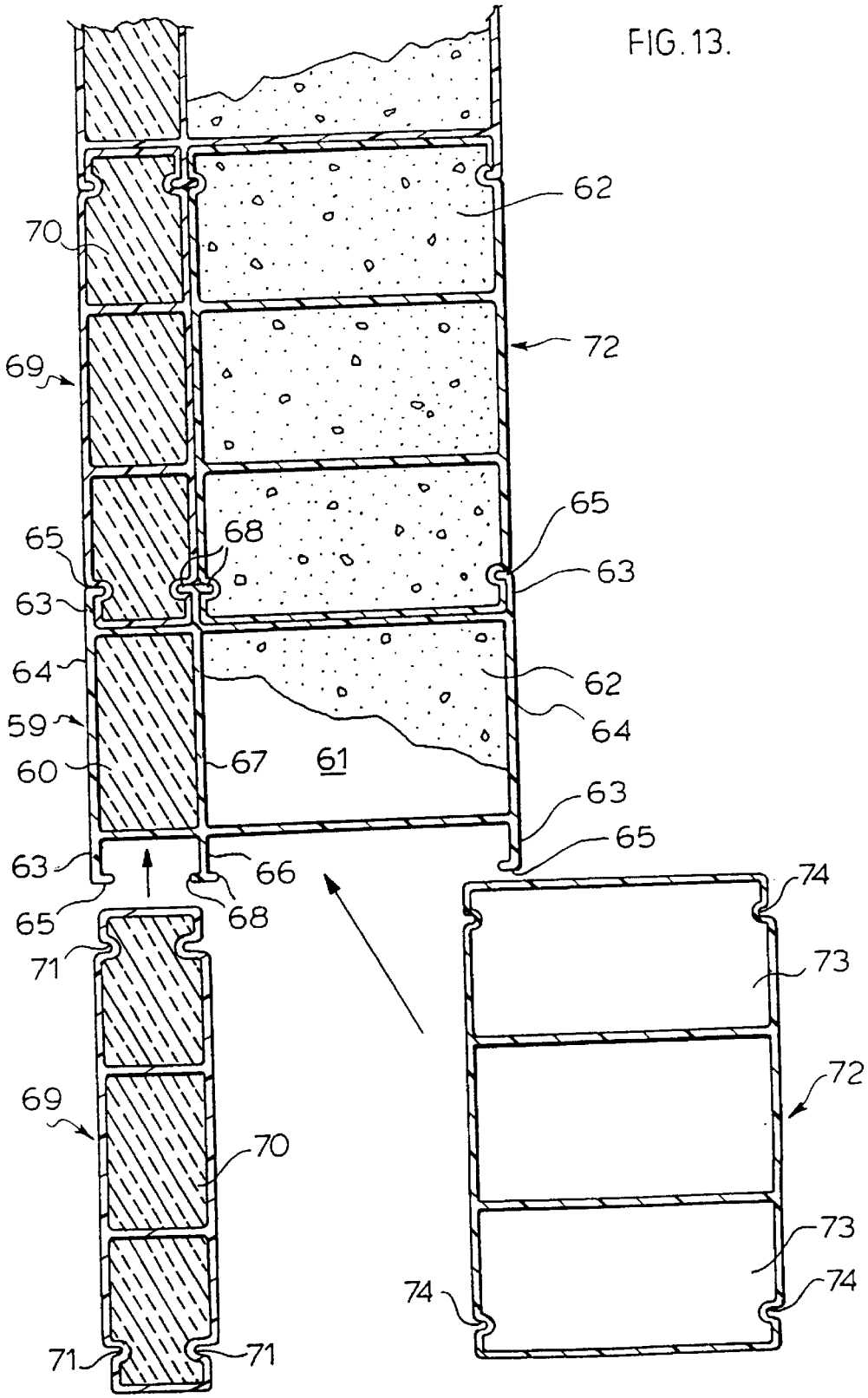
FIG. 13 is a broken away plan view of the section of a wall structure according to the invention in which individual insulation receiving and concrete receiving sections are integrated into the interlocked wall structure of the invention to provide an interlocked wall which presents a row of insulation receiving compartments filled with insulation bordering a row of concrete receiving compartments filled with concrete.

In an alternative arrangement illustrated in FIG. 13, an interlocking wall embodying the invention is formed by the utilization of a box connector 59 having an insulation compartment filled with insulation indicated at 60 and a concrete receiving compartment 61 adapted to be filled with concrete 62.

The box connector 59 has at each side thereof projections 63 in line with the exterior faces 64 of the box connector and terminating in inturned locking Figures 65 and as well an extension 66 in line with the wall 67 dividing the insulation 60 from the concrete 62. The extension 66 has a pair of fingers 68 one facing and arranged to cooperate with one of the locking fingers 65 and the other facing and adapted to cooperate with the other locking finger 65.

In this case, a separate insulation panel 69 filled with insulation material 70 and provided with locking grooves 71 is adapted to be slideably interlocked with the one set of locking fingers 65 and 68 as illustrated.

A separate hollow panel 72 provided with compartments 73 for receiving concrete is also provided with grooves 74 which are adapted to slideably interlock with the other pair of fingers 65 and 68 as illustrated. Again the box connectors 59 containing the insulation 60 are interlockingly engaged with the insulation containing panels 69 and the concrete receiving panels 72 into a interlocked wall formation ready to receive concrete 62 poured into the box connector, it being understood that the box connector and panels 72 will be provided with the requisite openings to allow internal flow of concrete both internally of the components and of the wall to result in an integral concrete encased insulated wall structure.

Figure 14:
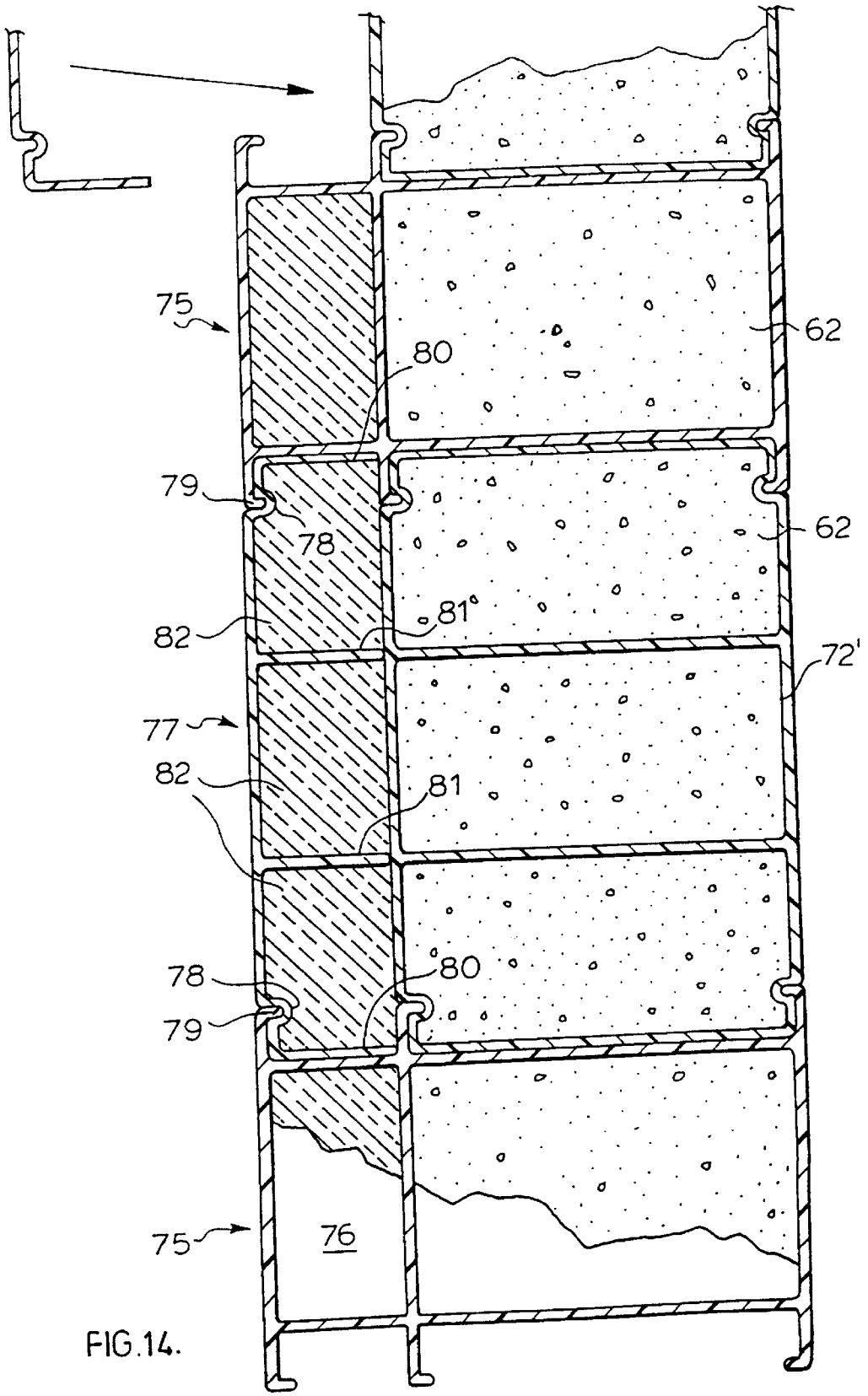
FIG. 14 is a view similar to FIG. 13 showing another arrangement of components to provide an interlocked wall according to the invention presenting a row of insulation receiving compartments filled with insulation bordering a row of concrete receiving compartments filled with concrete.

FIG. 14 shows another alternative arrangement in which a box connector 75 having an insulation receiving chamber 76 is used to connect together concrete receiving panels 72' corresponding to the panels 72 of FIG. 13 and an extrusion 77 having grooves 78 for interlocking engagement with fingers 79 of the box connector 75 and end legs 80 and intermediate legs 81 to define when interlocked in conjunction with the panels 72' compartments which can be filled with insulating material 82.

Figure 15:
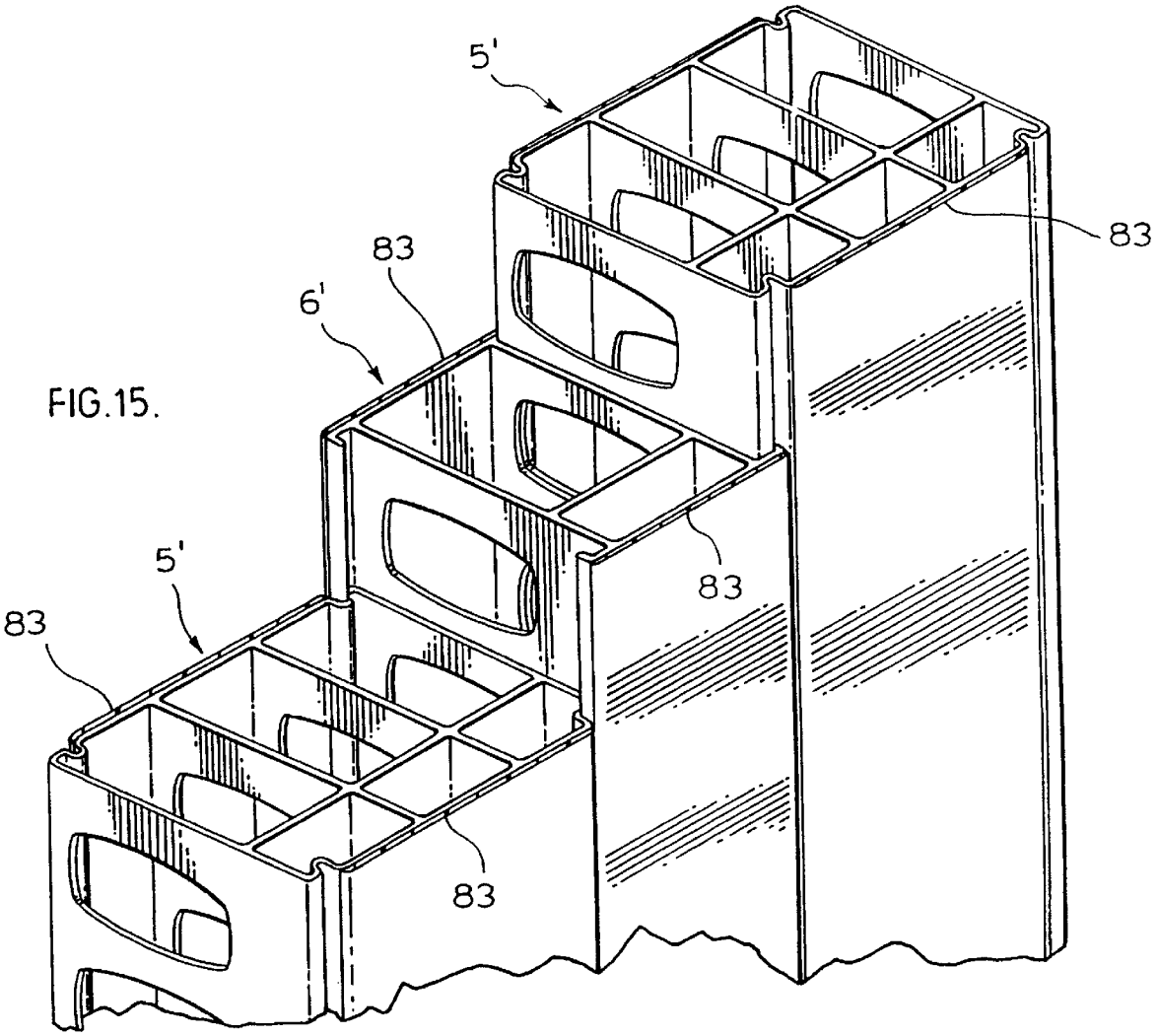

FIG. 15 is a perspective view illustrating wall panels 5' and box connector 6' that are the same as wall panels 5 and box connectors 6 except that they are coextruded to provide a thin covering skin or cap stock 83 on surfaces which become exterior surfaces of the wall formed thereby when they are interlockingly connected. This cap stock may be PVC or other suitable thermoplastic material and may contain additives to provide resistance to ultraviolet radiations, weathering and impact as will be understood by those skilled in the art.

The components 5' and 6' and corresponding corner elements not shown are for use in erecting above ground external walls that are subjected to excessive weathering and ultraviolet radiation. In addition, the cap stock 83 can incorporate colouring agents to provide an exterior colour if desired.

Figure 16:
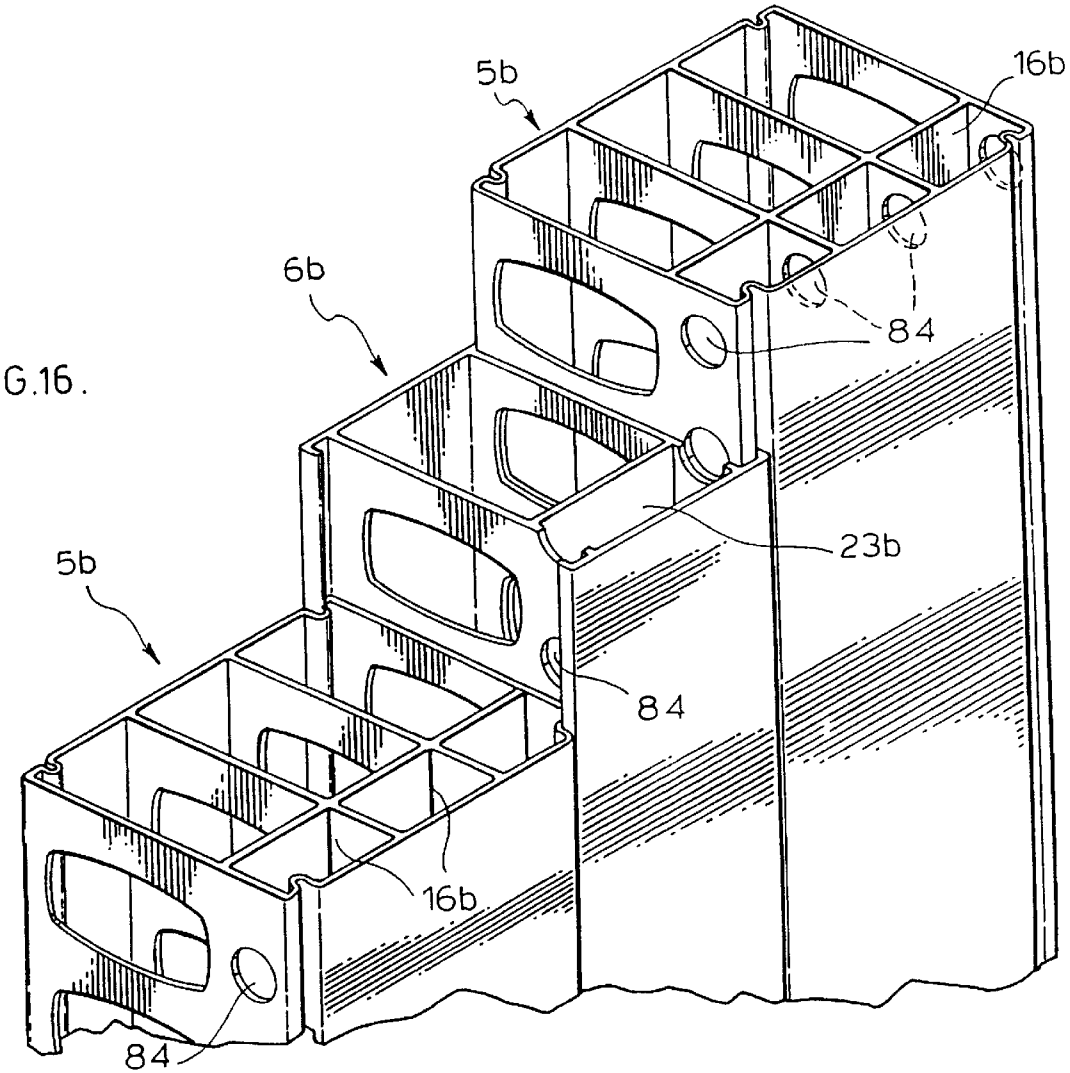
FIG. 16 is a broken away perspective view showing the assembly of wall forming components similar to FIGS. 3 and 4 but showing the insulation receiving compartments as having openings in the walls thereof to provide internal communication between these compartments as well as the openings in the concrete receiving compartments providing internal communication therebetween.

FIG. 16 illustrates wall forming panels **5*b* corresponding to wall forming panel 5 and box connector 6*b* corresponding to box connector 6 differing only in that holes 84 are provided to afford communication interiorly between the insulation compartments 16*b* of the panels and as well communication between the interlocked components with the insulation receiving compartment 23*b* of the box connector 6*b***.

With this arrangement, insulation can be foamed into the wall structure when it is interlocked to flow between the compartments **16*b* and 23*b* in the same manner that concrete can be introduced into the box connector 6*b* and flow into the interlocked panels 5*b***.

Figure 17:
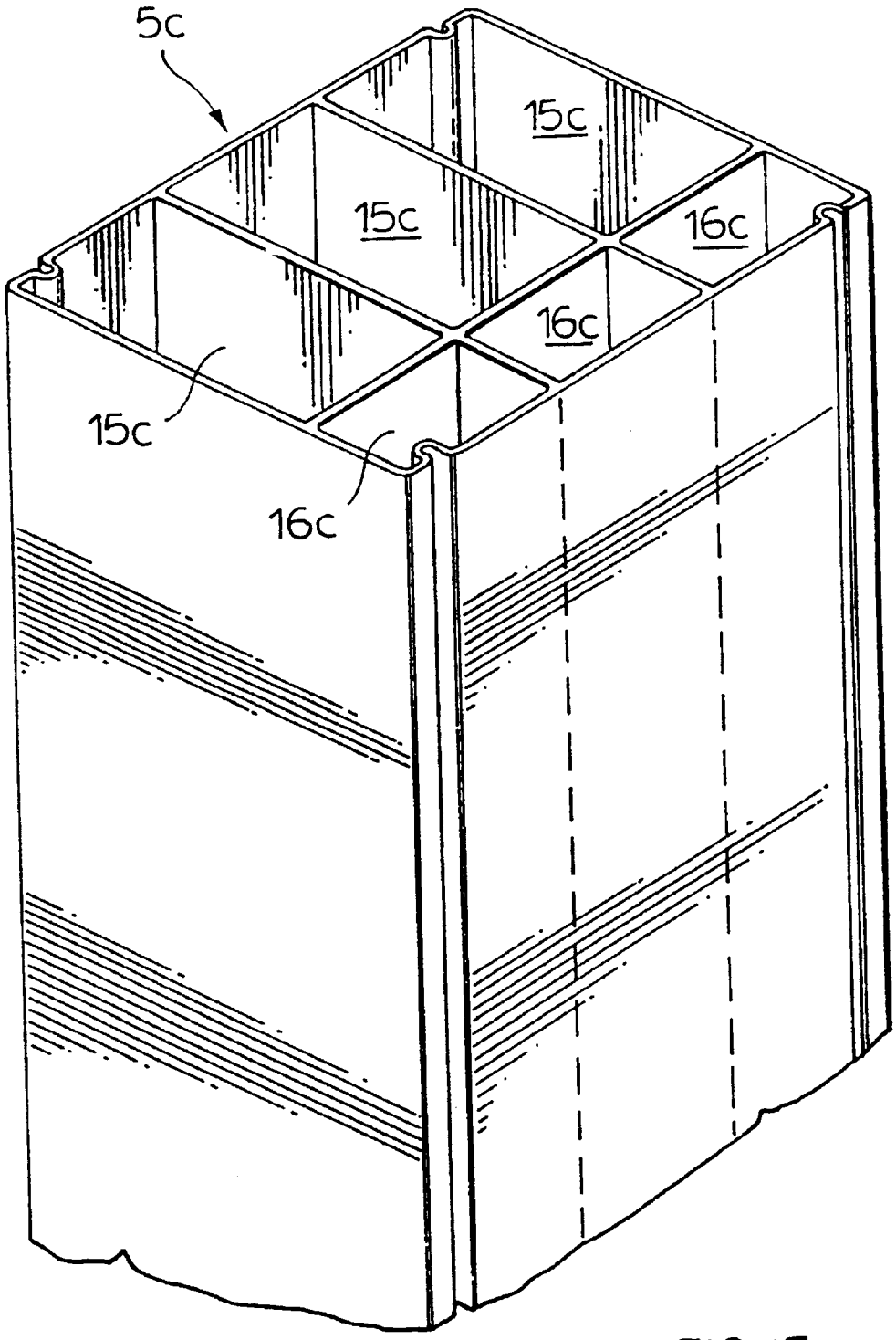
FIG. 17 is a broken away perspective view of a panel extrusion corresponding to FIG. 3 as it issues from the extruder but without the cut outs in the walls of the concrete receiving compartments.

FIG. 17 illustrates a wall forming panel **5*c* which corresponds in all respects to wall forming panel 5 as it issues from the extruder but without, or before, any coring so that no openings corresponding to the openings 17 in panel 5 have been provided. However the panel does have concrete receiving compartments 15*c* and insulation receiving compartments 16*c*** arranged to block heat transfer through the panel.

Figure 18:
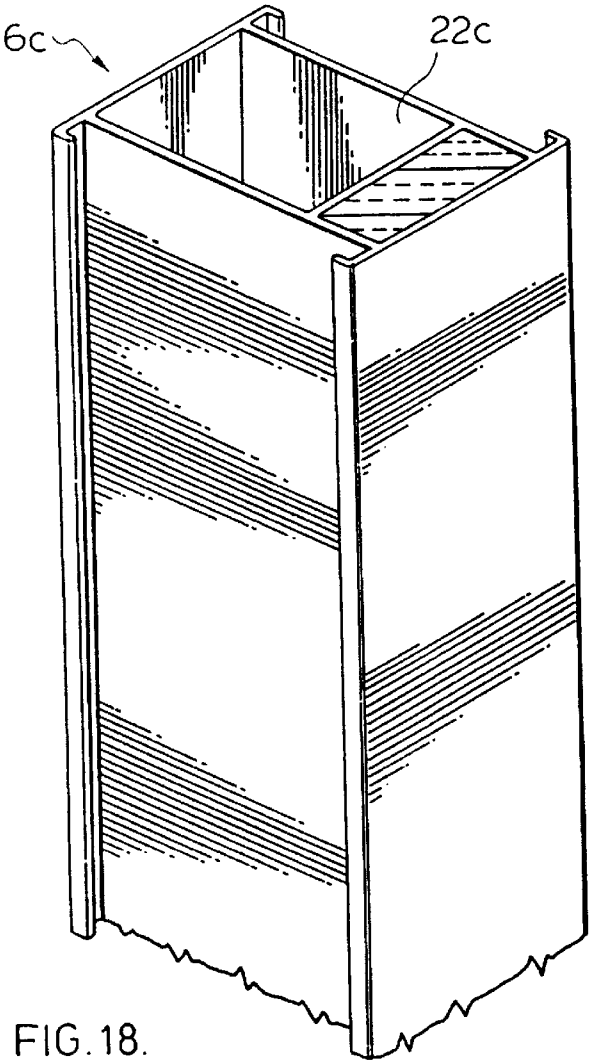
FIG. 18 is a perspective view of a box connector corresponding to FIG. 4 as it issues from the extruder but without the cut outs in the walls of the concrete receiving compartment but showing the insulation receiving compartment filled with insulation.

FIG. 18 illustrates a box connector **6*c* which is in all respects the same as box connector 6 as it issues from the extruder but without, or before, any coring so that no openings corresponding to the openings 25 are provided into the interior of the concrete receiving compartment 22*c***.

Figure 19:
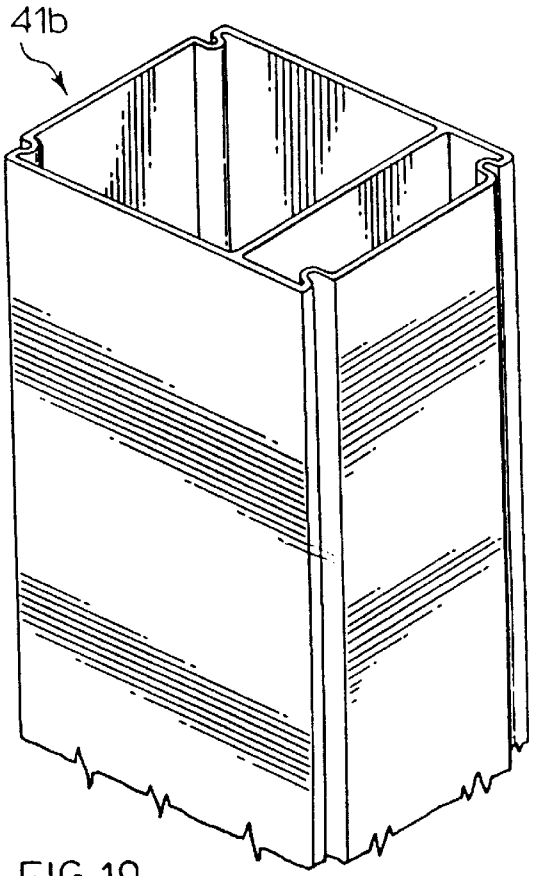
FIG. 19 is a broken away perspective view of a narrow panel component similar to FIG. 10 as it issues from the extruder but without the cut outs in the walls of the concrete receiving compartment.

FIG. 19 illustrates a short wall forming panel **41*b* corresponding in every respect to wall forming panel 41 as it issues from the extruder but without, or before, any coring so that no openings corresponding to the openings 45 in panel 41** are present.

It will be understood that the wall panel of FIG. 17 (**5*c*), the box connector of FIG. 18 (6*c*), and the small panel of FIG. 19 (41*b***) without being cored can be interconnected by tie rods or the like (not shown) into a connected wall formation to provide an insulated wall when the respective insulation receiving compartments are filled with insulation but that concrete would have to be poured individually into the concrete receiving compartments or into such of them as desired.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A wall forming component comprising an integral elongated hollow extrusion of thermoplastic material, said hollow extrusion having a rectilinear cross section and having means for interlocking engagement with mating components for assembly into a wall structure in which a pair of spaced parallel walls of said component form exterior wall segments of said wall structure characterized in that said component is extruded to have a formation of walls which become internal walls when said component is assembled into a wall structure, providing walls which extend transversely between and are integrally connected to said spaced parallel walls and at least one wall extending parallel to and spaced from said pair of spaced parallel walls and connected at each end thereof to one of said transverse walls to divide the interior of said component into at least one enclosed rectilinear insulation receiving compartment and at least one rectilinear concrete receiving compartment.

2. A wall forming component as claimed in claim 1 characterized in that said walls extending transversely between said spaced parallel walls are provided with openings therethrough to provide flow access through said at least one concrete receiving compartment.

3. A wall forming component as claimed in claim 1 characterized in that said at least one rectilinear insulation receiving compartment is filled with insulation material.

4. A wall forming component as claimed in claim 1 characterized in that said component has a single rectilinear insulation receiving compartment and a single concrete receiving compartment.

5. A wall forming component as claimed in claim 1 characterized in that said component is a panel having a plurality of insulation receiving compartments and a plurality of concrete receiving compartments.

6. A wall forming component as claimed in claim 5 characterized in that each of said rectilinear insulation receiving compartments is narrower than each of said rectilinear concrete receiving compartments.

7. A wall structure for an insulated wall characterized in that said wall structure comprises a plurality of elongated rectilinear hollow extruded thermoplastic components provided with interlocking means interlocked together to provide a pair of spaced parallel exterior walls and formed to present an internal wall formation comprising transverse walls extending between and integrally connected to said exterior walls and walls extending parallel to said exterior walls and integrally connected at their ends to said transverse walls whereby there is presented within said spaced parallel exterior walls at least two longitudinal rows of rectilinear compartments enclosed within said exterior walls one of said row of rectilinear compartments being adapted for containing insulating material and the other to receive concrete.

8. A wall structure as claimed in claim 7 characterized in that said rectilinear compartments for containing insulating material are formed within said hollow interlocking components and contain insulation material prior to erection of said wall structure.

9. A wall structure as claimed in claim 7 characterized in that said hollow thermoplastic extrusions are cored to provide openings such that when said components are interlocked together communication is provided between the compartments of the row of rectilinear compartments adapted to receive concrete.

10. An insulated wall characterized in that it comprises a plurality of elongated extruded thermoplastic components which incorporate solid rectilinear bodies of insulating material, said components being interlocked together to provide spaced parallel uninterrupted exterior walls connected together by integral transverse walls spanning therebetween and to present at least one row of solid rectangular bodies of insulating material extending parallel to said exterior walls between said transverse walls and a row of rectangular concrete receiving compartments bordering said row of rectangular bodies of insulating material, said row of concrete receiving compartments bang in communication with each other for the flow of concrete therebetween.

11. A wall forming component comprising an elongated hollow extrusion of thermoplastic material having a rectilinear cross section and having means for interlocking engagement with mating components for assembly into a wall structure, said component having a pair of spaced parallel uninterrupted exterior walls to form exterior wall segments of a wall structure when said component is assembled into a wall structure and having a formation of walls between said exterior walls which become internal walls when said component is assembled into a wall structure, said formation of walls comprising walls which extend transversely between and integrally connected to said exterior walls and at least one wall extending parallel to and spaced from said exterior walls connected at each end thereof to one of said transverse walls to divide the interior of said component into at least one rectilinear insulation receiving compartment and at least one rectilinear concrete receiving compartment said uninterrupted exterior walls isolating said compartments from the atmosphere in a direction transversely of said exterior walls.

12. A wall forming component as claimed in claim 11 in which said walls extending transversely of said parallel walls are cored to provide flow through said at least one concrete receiving chamber in a direction parallel said exterior walls.

13. A wall forming component as claimed in claim 11 or 12 in which said transverse walls are cored to provide flow through said at least one insulation receiving compartment in a direction parallel said exterior walls.

* * * * *